United States Patent [19]

Morinaga et al.

[11] 4,014,277

[45] Mar. 29, 1977

[54] CONTROL APPARATUS FOR SEWING MACHINE WITH AUTOMATIC NEEDLE STOPPING MEANS

[75] Inventors: Shigeki Morinaga; Kazuo Onishi, both of Hitachi, Japan

[73] Assignee: Hitachi, Ltd., Japan

[22] Filed: May 12, 1975

[21] Appl. No.: 576,600

[30] Foreign Application Priority Data

May 15, 1974 Japan ..... 49-53326

[52] U.S. Cl. ..... 112/219 A

[51] Int. Cl.[2] ..... D05B 69/18

[58] Field of Search ..... 112/219 A, 121.11

[56] References Cited

UNITED STATES PATENTS

| | | | |
|---|---|---|---|
| 3,074,632 | 1/1963 | Braun et al. | 112/121.11 X |
| 3,209,713 | 10/1965 | Cohen et al. | 112/219 A |
| 3,757,232 | 9/1973 | Matsuda | 112/219 A |

*Primary Examiner*—Werner H. Schroeder
*Assistant Examiner*—Peter Nerbun
*Attorney, Agent, or Firm*—Craig & Antonelli

[57] ABSTRACT

A control apparatus for sewing machine with automatic needle stopping means comprises a motor for supplying a driving force to a sewing machine, a speed control device for controlling the rotational speed of the motor by controlling a driving thyristor connected to the motor, a position detector unit for detecting the position of a sewing machine needle, a braking unit for applying a braking force to the motor to stop the motor and the sewing machine at a predetermined position, and a pedal manipulated by an operator for manipulating the sewing machine. The speed control device comprises a speed command means including a speed detector means resetable by an output signal from the position detector unit for detecting the motor speed, and a counter means having inputs setable by electrical signals generated in response to the manipulation of the pedal, a given sewing cycle being performed by output signals of the counter means.

6 Claims, 8 Drawing Figures

4
9
8
THYRISTOR
3
2
PHASE CONTROL UNIT
7
COMMAND UNIT
6
Q5
Q1
Q3
Q4
Q4
Q2
5
FORWARD TREADING
NEUTRAL TREADING
REVERSE TREADING
DYNAMIC BRAKING DEVICE
13
COUNTER EMF DETECTOR
10
LOW SPEED DETECTOR UNIT
11
DC MOTOR
1
ELECTRO-MAGNETIC BRAKE
12
19
W
WIPER
K
KNIFE
P
PICKER
SEWING MACHINE
16
20
17
LOW POSITION DETECTOR
HIGH POSITION DETECTOR
18

NH
NL
t1
t2
t3
t4
t5
t6
t7
A
C
Q1
Q2
Q3
Q4
Q5
Q6
Q7
Q8
Q9
S1
S2

CONTROL APPARATUS FOR SEWING MACHINE WITH AUTOMATIC NEEDLE STOPPING MEANS

BACKGROUND OF THE INVENTION

1. Field of the Invention

This invention relates to a control apparatus for sewing machine, and more particularly to a control apparatus for industrial sewing machine with automatic needle stopping means.

2. Description of the Prior Art

Recently, control apparatus with sequence control for use in industrial sewing machines have been developed.

For convenience, of explanation, a co-ordinate system is assumed in which the ordinate represents the rotational speed N of a sewing machine shaft driven by a motor and abscissa represents time. A sewing machine is started and operated at a high speed $N_H$. If the sewing machine is provided with a deceleration command, the motor is disconnected from a power source and a brake is actuated to facilitate the deceleration of the sewing machine. When the speed falls to a predetermined low speed $N_L$ at time (second) after the provision of the deceleration command, the braking action is loosened and the low speed $N_L$ is retained till time (second) for positioning. As the sewing machine needle travels and reaches a specified position, for example, low position, the position detector unit is so actuated as to energize an electromagnetic brake. The electromagnetic brake is slightly delayed to operate on account of its inherent time lag and it causes the sewing machine needle to stop at the low position. Then, the sewing machine is reactuated at the low speed by a command from an operator. While the sewing machine needle travels from the low position to the high position, a thread is automatically cut off. The sewing machine needle is stopped at the high position and one sewing cycle is completed.

Many sewing machine control apparatus performing such control mode employ a command circuit incorporated with a number of control elements, for example, flip-flops. Therefore, these control apparatus are sensitive to noises and prone to erroneous operations, giving rise to impairment of reliability. Besides, they are complicated.

SUMMARY OF THE INVENTION

An object of the invention is to provide a highly reliable industrial sewing machine control apparatus which comprises a command circuit including at least one counter means producing central command signals to assure various sequence controls and to prevent erroneous operations due to noises.

Another object of the invention is to provide an improved industrial sewing machine control apparatus in which even when an automatic thread cutting means is applied with input signals continuously, it is operated only by an initial input signal and prevented to continue operation with subsequent input signals, thereby avoiding influence on other related devices.

According to the invention, there is provided a control apparatus for sewing machine with automatic needle stopping means, comprising a motor for supplying a driving force to a sewing machine, a speed control device for permitting the motor to drive at a commanded speed, a position detector unit for detecting the position of a sewing machine needle, a braking unit for applying a braking force to the motor to stop the motor and the sewing machine at a predetermined position, and a pedal manipulated by an operator for manipulating the sewing machine, wherein the speed control device comprises a speed command unit including at least one counter means which produces central command signals to perform a specified sequence control.

DESCRIPTION OF THE PREFERRED EMBODIMENT

Figure 1:
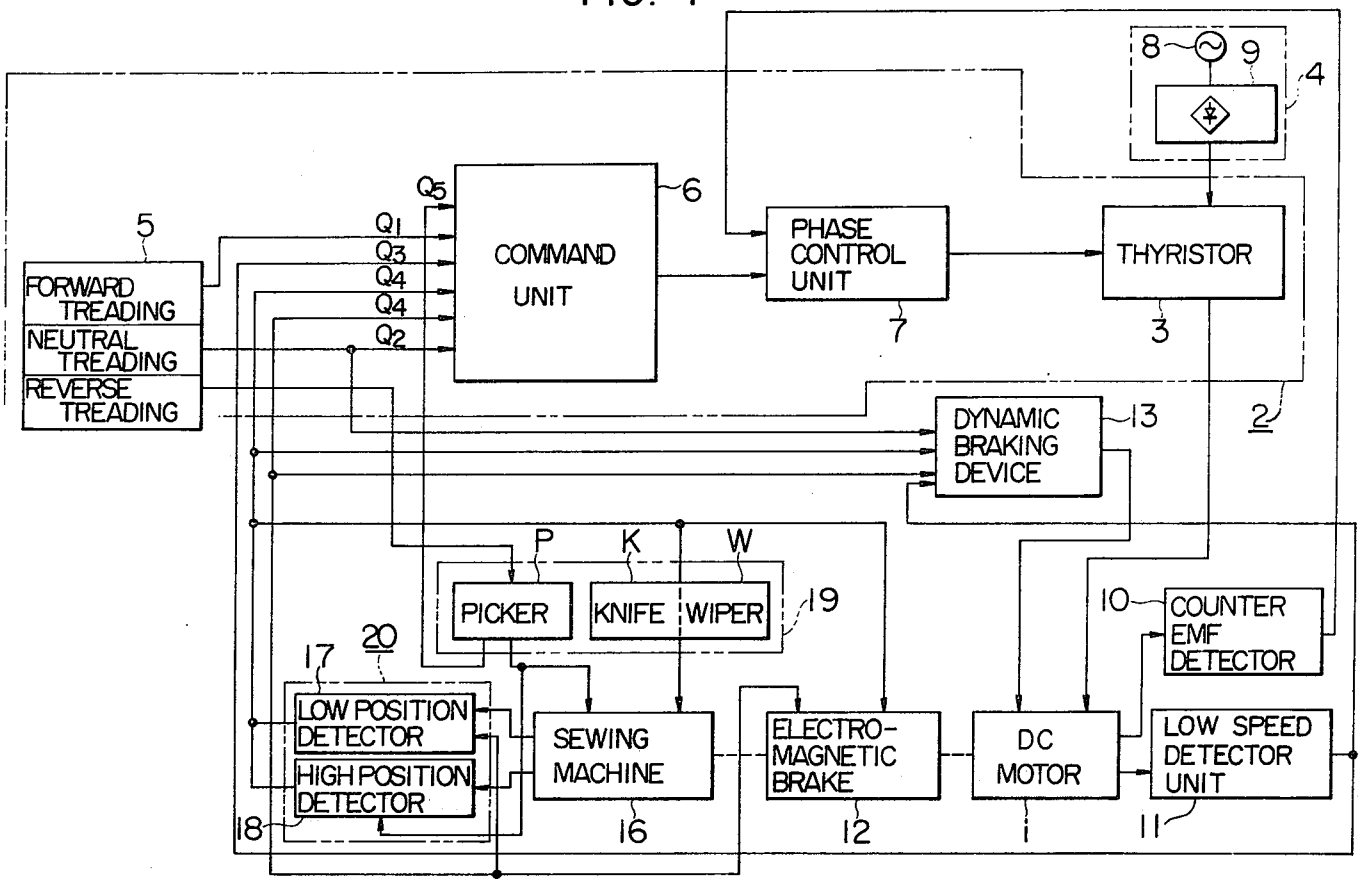
FIG. 1 is a block diagram of one embodiment of the invention.

Referring now to FIG. 1 showing a block diagram of one embodiment of a control apparatus according to the invention, a DC motor 1 is connected to a DC power supply unit 4 through a thyristor 3 of a speed control device 2. The speed control device 2 comprises a command unit 6 for regulating the speed of the DC motor 1 to a predetermined speed in response to the position of a pedal 5 manipulated by an operator of the sewing machine, and a phase control unit 7 for controlling the fired phase angle of the thyristor 3 is response to an output of the command unit 6.

The DC power supply unit 4 includes an AC power source 8 of commercial frequency and a full-wave rectifier 9 which rectifies an AC voltage from the AC power source 8. Reference numeral 10 designates a counter electromotive force detector adapted to detect a counter electromotive force proportional to the speed of the DC motor 1, whose output is feedback negatively to the phase control unit 7 of the speed control device 2 to make equal the speed of the DC motor 1 to a commanded speed.

Reference numeral 11 designates a low speed detector unit adapted to detect the amplitude of a braking current for the DC motor 1. The low speed detector unit 11 produces an output signal for controlling a dynamic braking unit 13 only when braking current falls below a set value, so as to maintain the speed of the DC motor 1 at a predetermined low speed. To this end, the low speed detector unit 11 comprises a current detector for detecting the amplitude of braking current flowing through the DC motor 1, which current detector is transferred from a first output state (ON) to a second output state (OFF) whenever the braking current exceeds the set value whereas transferred from the second output state (OFF) to the first output state (ON) whenever the braking current falls below the set value.

A sewing machine 16 is coupled with the DC motor 1 so as to be driven thereby and it comprises a position detector unit 20 comprised of a low position detector 17 and a high position detector 18, for detecting positions at which a sewing machine needle stops. The low position detector 17 energizes an electromagnetic braking unit, for example, an electromagnetic brake 12, only when the needle of the sewing machine 16 travels at a given low stop position and at the same time the output signal of the low speed detector unit 11 is presented.

On the other hand, the high position detector 18 not only energizes the electromagnetic brake 12 but also actuates a knife K and wiper W of an automatic thread cutting unit 19 when the needle of the sewing machine 16 travels from the low stop position to a specified high stop position. The automatic thread cutting unit 19 also comprises a picker P controlled by means of a switch actuated by reverse tread on the pedal 5 of the operator. When the operator steps on the pedal 5 reversely, the picker P is actuated through the switch to capture the thread and simultaneously supplies the command unit 6 with a low-speed operation command to enable the DC motor 1 to rotate at low-speed.

Therefore, the capture of the thread by the picker P is followed by the low-speed rotation of the DC motor 1 and when the needle of the sewing machine 16 is raised to the specified high stop position to actuate the high position detector 18, the electromagnetic brake 12 is energized to stop the DC motor 1.

While the needle of the sewing machine 16 is stopped at the high stop position, the knife K and wiper W are actuated to cut off the thread automatically and the thread is wiped away by the wiper W, thus making ready for next step.

Figure 2:
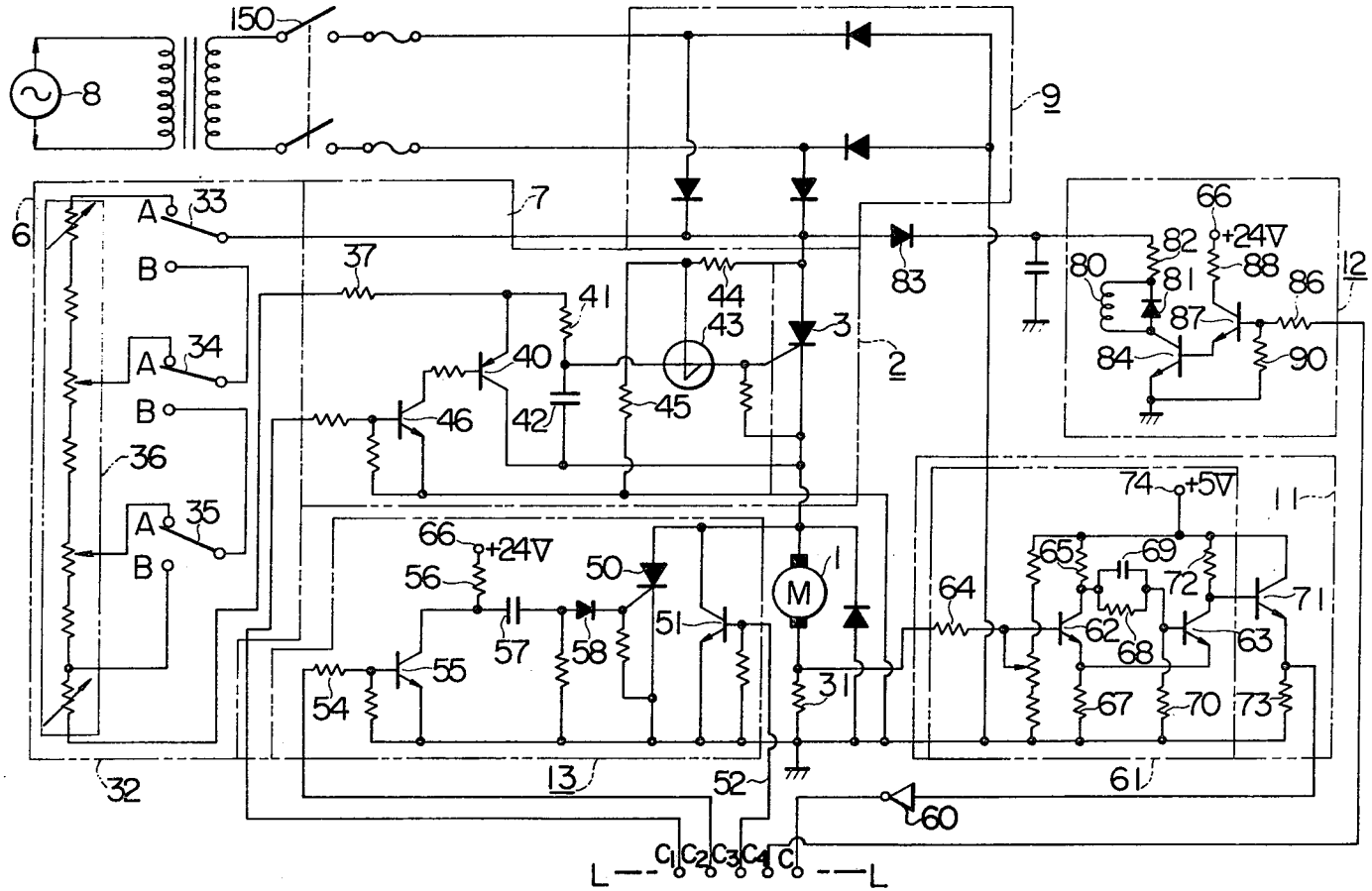
FIG. 2 is a connection diagram of a driving circuit of a control apparatus embodying the invention.
Figure 3:
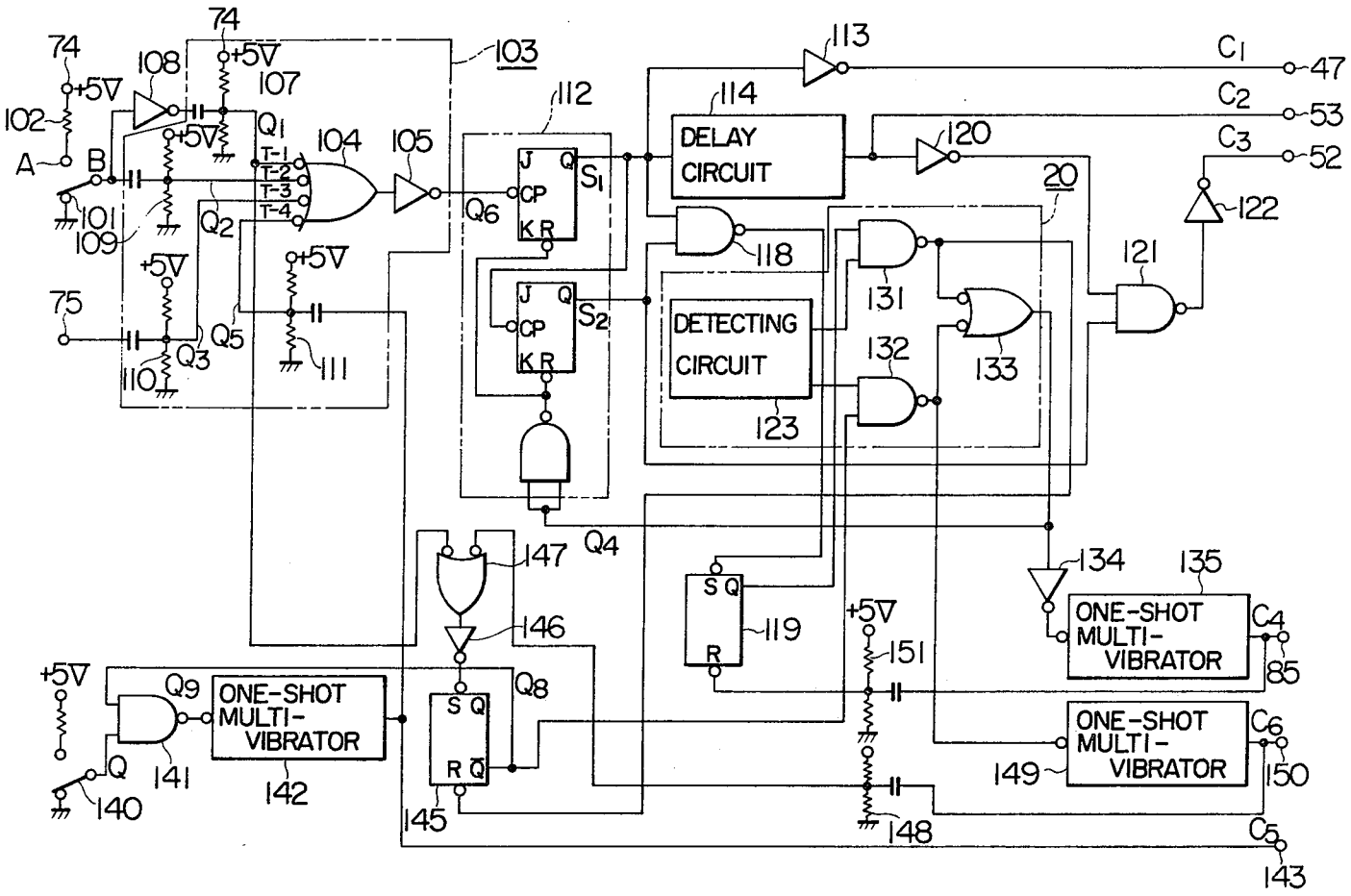
FIG. 3 is a connection diagram of a command circuit of the invention.

Turning to FIGS. 2 and 3, the control apparatus of the invention with construction as above will be detailed hereunder.

In a motor driving circuit as shown in FIG. 2, one end of the DC motor 1 is connected to an output terminal of the full-wave rectifier 9 through the thyristor 3 and the other end is grounded through a resistor 31. A speed setting circuit 32 of the speed control device 2 consists of switches 33 to 35 interlocked with the pedal 5 and a group of resistors 36 connected in series, the resistance of the resistor group being varied by the switches 33 to 35. The resistor group 36 is connected at one end to the output terminals of the full-wave rectifier 9 through the switch 33 and at the other end to a resistor 37 of the phase control circuit 7.

The phase control circuit 7 comprises a transistor 40 which is turned off by an output from an output terminal 47 of the command circuit when a contact A of a first switch 101 of FIG. 3 cooperative with the pedal 5 is closed, a series connection of a resistor 41 and a capacitor 42 connected between the emitter and collector of a transistor 40 in parallel therewith, and a unidirectional negative characteristic thyristor 43, for example, silicon unilateral switch by General Electric Corporation, whose anode is connected with a juncture between the resistor 41 and the capacitor 42 and whose cathode is connected with the gate of the thyristor 3. The emitter of the transistor 40 is connected to an output terminal of the speed setting circuit 32 through the resistor 37, the collector is connected to the cathode of the thyristor 3, and the base is connected to a control terminal 47 via a transistor 46 of preceding stage.

A series connection of resistors 44 and 45 constitutes the counter electromotive detector 10 for the DC motor 1 wherein one end of the resistor 44 is connected with the anode of the thyristor 3 and the other end is connected through the resistor 45 to the resistor 31 connected in series with the DC motor 1 to be grounded. Therefore, a closed circuit is constituted with the resistors 44, 45 and 31, DC motor 1 and thyristor 3. Connected to the gate of the unidirectional negative characteristic thyristor 43 is a juncture between the resistors 44 and 45.

The dynamic braking unit 13 includes a thyristor 50 connected in parallel with the DC motor 1, an anode of which is connected with the positive terminal of the DC motor 1 along with a collector of a transistor 51 and a cathode of which is grounded along with an emitter of the transistor 51 and the resistor 31. The transistor 51 is connected at its base to a control terminal 52. Reference numeral 55 designates a transistor with its base connected to a control terminal 53 through a resistor 54, with its collector connected to the gate of the thyristor 50 through a capacitor 57 and a diode 58 and in addition, to a DC voltage terminal 66 (+ 24 volts) through a resistor 56 and with its emitter grounded. Reference numeral 61 designates a Schmidt circuit comprised of transistors 62 and 63 which constitutes the current detector of the low-speed detector unit 11. The transistor 62 has its base connected through a resistor 64 to a juncture between the DC motor 1 and the resistor 31, its collector connected through a resistor 65 to a DC voltage terminal 74 (+ 5 volts), and its emitter in common with an emitter of the other transistor 63 grounded through a resistor 67.

A base of the transistor 63 is connected through a parallel connection of a resistor 68 with a capacitor 69 to the collector of the transistor 62 and through a resistor 70 to ground. A collector of the transistor 63 is connected to a base of a transistor 71 and to the DC voltage terminal (+ 5 volts) through a resistor 72. The transistor 71 is with its collector connected to the DC voltage terminal 74 and with its emitter connected through a resistor 73 to ground and through an inverter 60 to a control terminal 75 as well.

Reference numeral 80 designates a coil of the electromagnetic brake 12 connected in parallel with a diode 81, one end of the coil 80 being connected through a resistor 82 and a diode 83 to the output terminals of the full-wave rectifier 9 and the other end grounded through a collector-emitter junction of a transistor 84.

Reference numeral 85 designates a control terminal through which a signal is supplied to the electromagnetic brake 12. This control line is connected through a resistor 86 to a base of a transistor 87 having its collector connected to the DC voltage terminal 66 (+ 24 volts) through a resistor 88 and its emitter connected to a base of the transistor 84 which is coupled with the coil 80. Between the base of the transistor 87 and the emitter of the transistor 84 is connected a resistor 90.

Terminals illustrated as aligned on line L — L of FIG. 2 are followed by a command circuit as shown in FIG. 3. In FIG. 3, reference numeral 101 designates a first switch transferable between its stationary contacts A and B in cooperation with the aforesaid pedal 5, the contact A being connected through a resistor 102 to the DC voltage terminal 74 (+ 5 volts) and the contact B grounded. After the switch 101 is transferred to the contact A, the switches 33 to 35 (shown in FIG. 2) are transferred sequentially from contacts A to contacts B in response to the rocking movement of the pedal 5. An AND circuit generally designated at 103 is provided for the command circuit and comprises an NAND gate 104 with four input terminals T-1 to T-4 and an inverter 105 connected to an output of the NAND gate 104. Input terminals T-1, T-2, T-3 and T-4 of the NAND gate 104 are connected, respectively, to the switch 101 through a differential circuit 107 of resistor and capacitor and an inverter 108, to the switch 101 through another differential circuit 109, to the control terminal 75 through another differential circuit 110, and to an output of an one-shot multivibrator 142 to be described later through another differential circuit 111.

Figure 4:
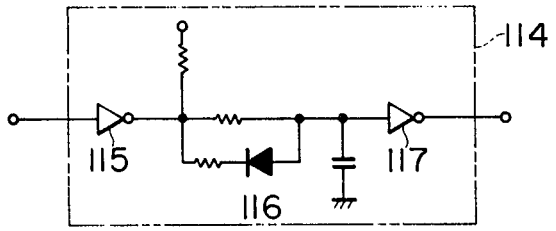
FIG. 4 is a connection diagram of a delay circuit of the command circuit.

A counter circuit generally designated at 112 is provided for the speed command unit 6 and it comprises four-bit binary counters (for example, type SN-7493 by Texas Instrument Incorporated) connected to serve as a two-bit binary counter with one input terminal, two output terminals $S_1$ and $S_2$, and one reset terminal. The input terminal of the counter circuit 112 is connected to the output terminal of the AND circuit 103. The first output terminal $S_1$ is connected to the terminal 47 through a inverter 113 and to a terminal 53 through a delay circuit 114 comprised of, as shown in FIG. 4, a series connection including an inverter 115, an integration circuit 116 and another inverter 117.

The first output terminal $S_1$ of the counter circuit 112 is also connected to an input of a NAND gate 118 whose other input is connected with the second output terminal $S_2$ and whose output is connected to a set terminal of a first flip-flop 119. The delay circuit 114 is connected with an inverter 120 and an output terminal of the inverter 120 is connected to an input terminal of a NAND gate 121 whose other input terminal is connected with the second output terminal $S_2$ of the counter circuit 112 and whose output terminal is connected through an inverter 122 to terminal 52.

Figure 5:
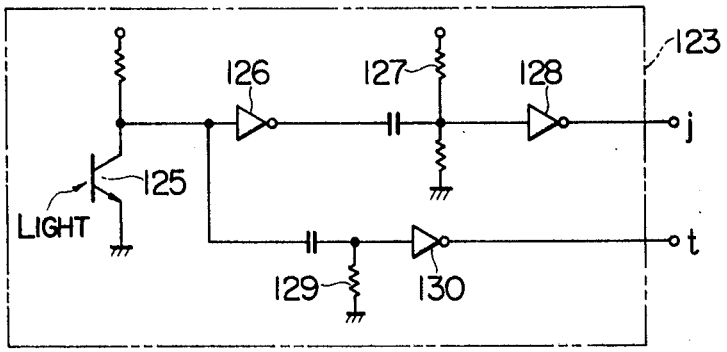
FIG. 5 is a connection diagram of a position detector circuit of the command circuit.

Reference numeral 123 designates a detecting circuit of the position detector unit 20 (shown in FIG. 1) for detecting the position of the sewing machine needle. In the detecting circuit 123, as shown in FIG. 5, an intermittent transmission of light signal in response to the rotation of the shaft of sewing machine 16 is received by a light receiving element, for example, phototransistor 125 to be converted into an electric signal, and the electric signal is derived out through an inverter 126, a differential circuit 127 and another inverter 128, thereby to produce a signal corresponding to the low position of the sewing machine needle, for example. By differentiating a collector potential of phototransistor 125 by means of a differential circuit 129 and by transmitting a differential signal through an inverter 130, a signal corresponding to the high position of the needle can be obtained. While one output terminal *j* (for low position detection) of the position detecting circuit 123 is connected to an input terminal of a NAND gate 131 whose other input terminal is coupled with an output terminal Q of the first flip-flop 119, the other output terminal *t* for high position detection is connected to a NAND gate 132 whose output terminal is connected to an input terminal of a NAND gate 133 the other input of which receives the output from the NAND gate 131. An output signal $Q_4$ of the NAND gate 133 is transmitted to the reset terminal of the counter circuit 112 and to the control terminal 85 through an inverter 134 and a first one-shot multivibrator 135.

A second switch designated at 140 is cooperative with the pedal 5 and produces an electric signal in response to, for example, reverse tread on the pedal 5. The second switch 140 is connected to an input of a NAND gate 141 which in turn is connected to a third one-shot multivibrator 142. An output terminal of the third one-shot multivibrator 142 is connected through the differential circuit 111 to the fourth input terminal T-4 of the NAND gate 104 included in the AND circuit 103 as described earlier, and also to a control terminal 143 through which the picker P is controlled.

Reference numeral 145 designates a second flip-flop whose set terminal is connected via an inverter 146 to an output terminal of a NAND gate 147, one input terminal of the NAND gate 147 being connected to the first input terminal T-1 of the NAND gate 104 included in the AND circuit 103 and the other input terminal to an output terminal of a second one-shot multivibrator 149 through a differential circuit 148. The output terminal of the second one-shot multivibrator 149 is also connected to a control terminal 150 through which the knife K and wiper W are controlled. The second one-shot multivibrator 149 has an input terminal connected to the output terminal of the NAND gate 132.

The first flip-flop 119 is provided with a reset terminal connected through a differential circuit 151 to the output terminal of the first one-shot multivibrator 135, and the second flip-flop 145 is provided with a reset terminal connected to the output terminal of the NAND gate 131.

Figure 6:
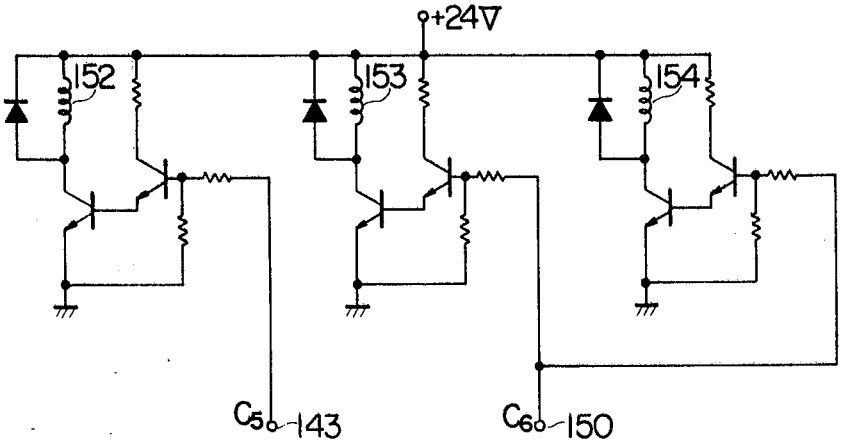
FIG. 6 is a connection diagram of a control circuit for a picker, knife and wiper.

Turning to FIG. 6, control circuits for controlling the picker P, knife K and wiper W comprise electromagnetic solenoids 152, 153 and 154, respectively. When a control signal is applied to a control terminal 143, the solenoid 152 for the picker is energized to actuate the picker P. Similarly, under the application of a control signal to the control terminal 150, the solenoids 153 and 154 for the knife and wiper are energized to actuate the knife K and wiper W.

The operation of the control apparatus of the invention will be described hereunder.

Figure 7A:
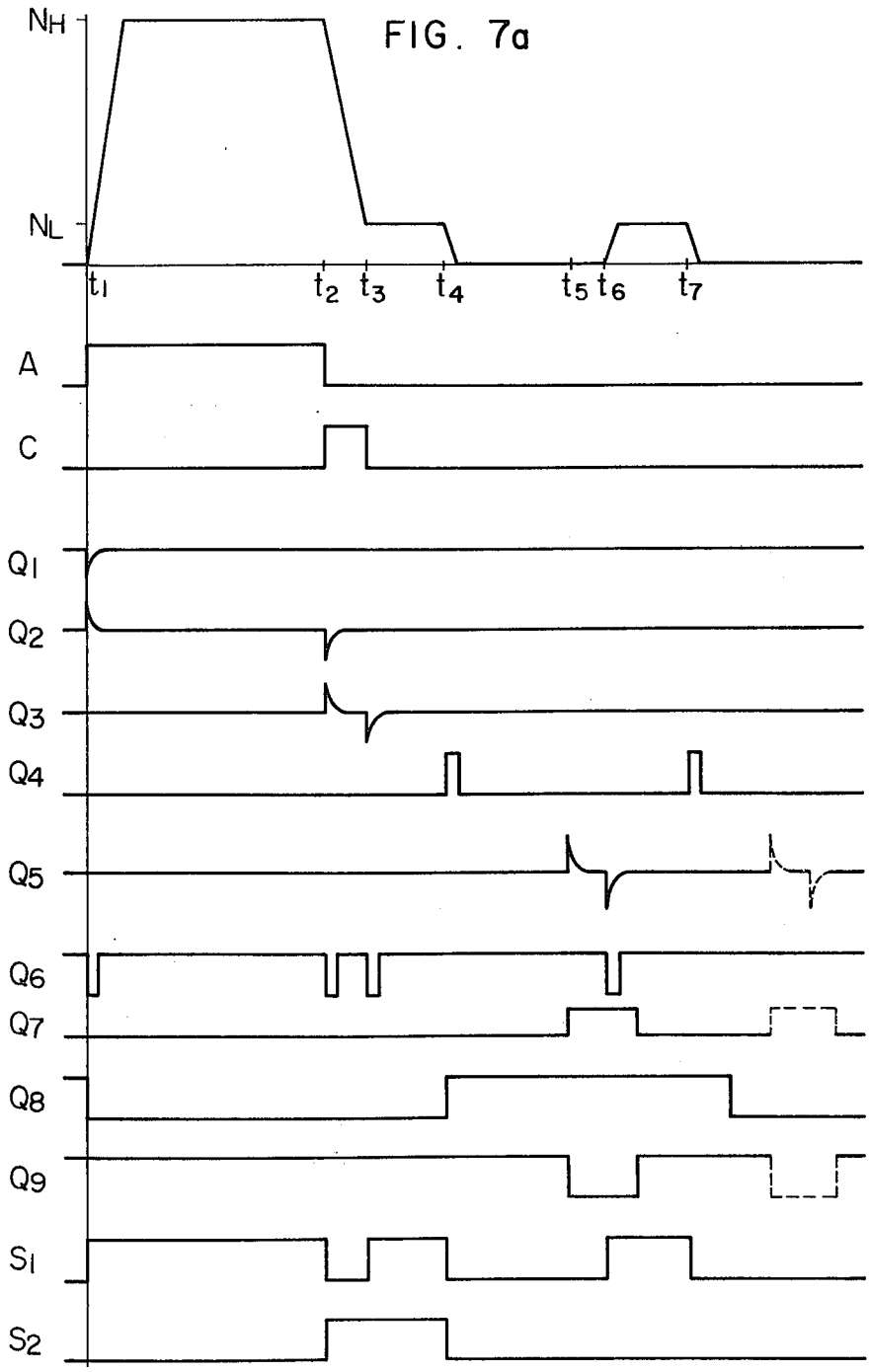
FIGS. 7*a* and 7*b* are waveform diagrams showing principal waveforms in the control apparatus embodying the invention.

A line switch 150 is firstly thrown onto supply AC power from AC power source 8. By treading on the pedal 5 forward, the first switch 101 cooperative with the pedal 5 is transferred to the contact A thereby to produce a signal A as shown in FIG. 7*a*. The signal A is inverted by the inverter 108 and then differentiated by the differential circuit 107 so that a trigger signal $Q_1$ is obtained. Since the trigger signal $Q_1$ is delivered to the input of the counter circuit 112 through the NAND gate 104 and the inverter 105, the counter circuit 112 counts the trigger pulse and produces signals $S_1$ and $S_2$ at the first and second output terminals, respectively. The signal $S_1$ is in the first output state (ON in this embodiment) and the signal $S_2$ is in the second output state (OFF in this embodiment). The output signal $S_1$ is inverted by the inverter 113 to produce a control signal $C_1$ at the control terminal 47. At this time, since the transistors 46 and 40, which will be controlled by a control signal supplied through the control terminal 47, are retained non-conductive, a DC current derived from the full-wave rectifier 9 charges the capacitor 42 through the switch 33 and the resistor group 36 of the speed setting circuit 32, and the resistors 37 and 41.

On the other hand, a DC voltage from the full-wave rectifier 9 is applied to the anode of the thyristor 3 and a division of the anode voltage for the thyristor 3 by the resistors 44 and 45 is applied to the gate of the unidirectional negative characteristic thyristor 43. As a result, the unidirectional negative characteristic thyristor 43 controlled thereby is rendered conductive so that the thyristor 3 may also be rendered conductive through the thyristor 43 to enable the DC motor 1 to start. On this occasion, since a signal $C_2$ appearing at the terminal 53 is in the first output state (ON), the transistor 55 of the dynamic braking unit 13 is rendered conductive to disable the dynamic braking unit 13.

Thereafter, as the operator treads on the pedal 5 forward, the switches 33 to 35 transfer, in this order, from the contact A to the contact B in response to the amount of treading so that the resistance of the resistor group 36 is decreased thereby to shorten the charging time for the capacitor 42. This causes a variation in the fired phase angle of the thyristor 3 such that the supply voltage to the DC motor 1 is increased, and as a result, the motor 1 is gradually accelerated until it rotates at a high speed.

Next, when the pedal 5 is trodden on neutrally (stop), the switch 101 is transferred to the contact B and in cooperation therewith the switches 33 to 35 are transferred to the contact A. With the switch 101 transferred to the contact B, the NAND gate 104 receives a trigger signal $Q_2$ at the second input terminal T-2 and this trigger signal produces a signal $S_2$ at the second output terminal of the counter circuit 112 through the NAND gate 104 and the inverter 105. At the same time, the control signal $C_1$ changes from OFF to ON to turn off the thyristor 3 and the control signal $C_2$ changes from the first output state (ON) to the second output state (OFF) with a slight delay so that the transistors 46 and 40 are rendered ON through the control terminal 47. Thus, the capacitor 42 is short-circuited by the transistor 40 with the result that the gate signal for the thyristor 3 controlled through the unidirectional negative characteristic thyristor 43 disappears, thereby automatically turning off the thyristor 3 during half cycle of the AC power source 8.

The control signal $C_2$, on the other hand, turns off the transistor 55 through the control terminal 53 and DC voltage (+ 24 volts) from the terminal 66 applies through the capacitor 57 and the diode 58 a gate signal to the gate of the thyristor 50 thus to turn it on. It is necessary to apply the gate signal to the thyristor 50 after the thyristor 3 is rendered OFF. This is because if the thyristor 50 becomes conductive during the conduction of the thyristor 3, the AC power source 8 will be short-circuited through the thyristors 3 and 50.

Where a DC power is derived from a full-wave rectifier for rectifying an AC voltage of, for example, 50 Hz frequency as in the invention, a time interval between the turning off of the thyristor 3 and the application of a gate signal to the thyristor 50, i.e., delay time is required to be 10 milliseconds of maximum (required for inverting the polarity of voltage) in order that the thyristor 3 is turned off. Such delay time $\alpha$ is determined through the delay circuit 114.

The output of the delay circuit 114 is inverted by the inverter 120 to be applied to the NAND gate 121 along with the second output signal $S_2$ of the counter circuit 112, the output of which is inverted through the inverter 122 to produce a control signal $C_3$. This control signal $C_3$ is applied to the base of the transistor 51 to turn on the same, which transistor is connected in parallel with the thyristor 50 and the DC motor 1. When both the thyristor 50 and the transistor 51 are turned on, the DC motor 1 serves as a DC generator which causes braking current to flow through the resistor 31, thyristor 50 and transistor 51 until the DC motor 1 reaches a predetermined low speed. In this manner, the conduction of the thyristor 50 inverts the current flowing through the DC motor 1 and the inverted current corresponding to the braking current increases.

During the braking mode of the DC motor 1, a voltage proportional to the rotational speed of the DC motor 1 is generated across the resistor 31 and at the time that the braking curent exceeds a negative set value (assumed that current flows in positive direction while the DC motor serves as a motor), the transistor 63 is rendered ON which is includes in the Schmidt circuit 61 of the low speed detector unit 11 connected across the resistor 31. In consequence, the output of the low speed detector unit 11 is rendered OFF together with resultant turning on of an output C of the inverter 60 as shown in FIG. 7*a*.

As the DC motor 1 is gradually decreased in speed until it reaches a scheduled rotational speed $N_L$ (FIG. 7*a*), the amplitude of the braking current decreases below the set value and the voltage across the resistor 31 connected in series with the motor 1 also decreases below a set level. This causes the transistor 62 of the Schmidt circuit 61 to turn on, thereby disabling the transistor 63 and enabling the transistor 71. This output of the low speed detector unit 11 is delivered to the third input terminal T-3 of the NAND gate 104 included in the AND circuit 103 through the inverter 60 and the control terminal 75.

In this manner, a trigger signal $Q_3$ is produced only when the amplitude of the braking current falls below the set value and it is representative of the decrease of speed of the motor 1 to the scheduled low speed (for example 400 rpm). Thus, the output at the AND circuit 103 is again applied, as a trigger signal, to the counter circuit 112 which in turn produces the signal $S_1$ at the first output terminal. On this occasion, the control signals $C_2$ and $C_3$ are in ON state and OFF state, respectively, and the thyristor 50 and the transistor 51 of the dynamic braking unit 13 are both turned off.

Accordingly, the transistors 46 and 40 controlled by the control signal $C_1$ through the control terminal 47 are both turned off so that the charging of the capacitor 42 commences and the DC motor 1 rotates at a low-speed.

Under this condition, the stop control of the sewing machine needle is performed. More particularly, the signals $S_1$ and $S_2$ of the first and second output terminals of the counter circuit 112 are applied to the AND gate 118, the output of which sets the first flip-flop 119. When the output of the first flip-flop 119 is in ON state and simultaneously the detecting circuit 123 of the low position detector 20 produces the low position detecting signal, the low position detecting AND gate 131 produces an output. The output of the low position detecting NAND gate 131 is applied through the inverter 134 to the one-shot multivibrator 135. The one-shot multivibrator triggered thereby transmits a signal through the control terminal 85 to turn on for a predetermined time interval the transistor 87 of the electromagnetic braking unit 12. Therefore, the coil 80 is energized to stop the sewing machine 16 and concurrently therewith, a trigger signal $Q_4$ is applied to the reset terminal of the counter circuit 112 so that the output signals $S_1$ and $S_2$ of the counter circuit 112 are both rendered OFF.

The above operation has been described in terms of a continuous sewing.

To stop sewing, the pedal 5 is trodden backward to switch on the second switch 140 cooperative with the pedal 5 by way of the automatic thread cutting unit 19.

The pedal 5 biased by a spring operates to automatically switch off the switch 140 when operator removes the back treading force on the pedal 5.

Figure 7B:
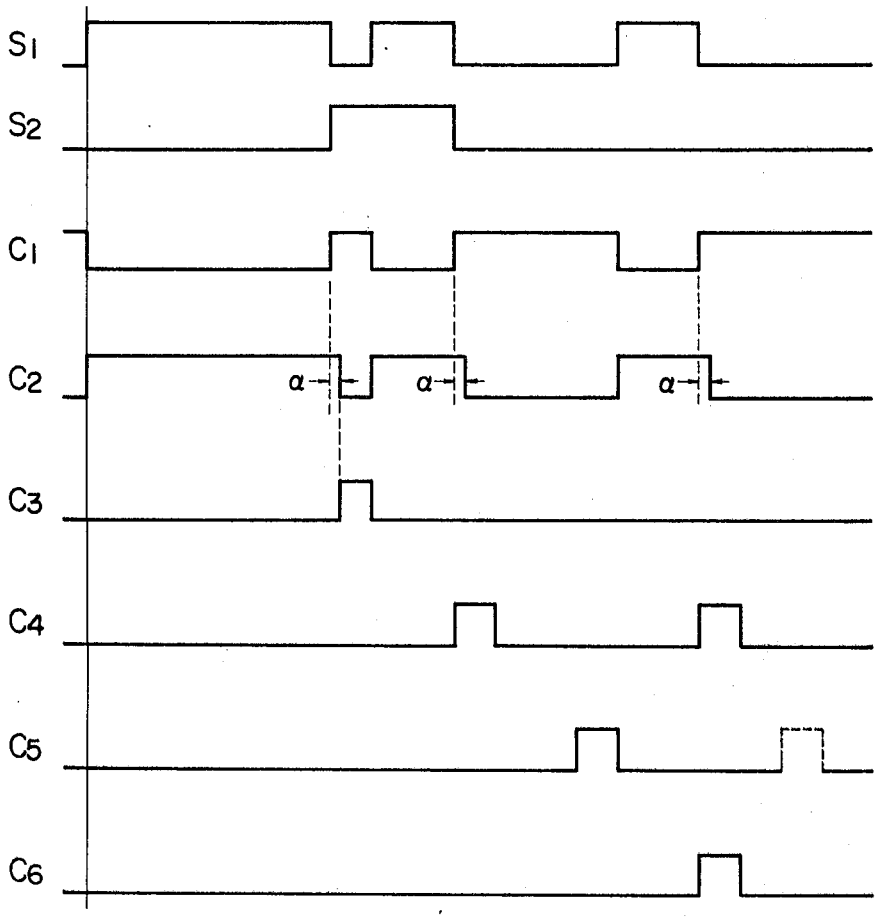

Turning now to FIG. 7, the operation of the second flip-flop 145 will be described.

When the trigger signal $Q_1$ is applied, a signal $Q_8$ of the flip-flop 145 changes from the first output state (ON) to the second output state (OFF). Also, the flip-flop 145 is reset by the output signal of the low position detecting NAND gate 131 to change from the second output state (OFF) to the first output state (ON). When the output of the second flip-flop 145 remains at the first output state after completion of a series of continuous sewing operation, the actuation of the second switch 140 causes the third one-shot multivibrator 142 through the NAND gate 141 to operate the picker P for a predetermined time duration.

A trigger signal $Q_5$ representative of the operation completion of the picker P causes the control signal $C_1$ to supply power to the DC motor 1. On this occasion, the control signal $C_2$ is in the first output state thus to prevent the dynamic braking unit 13 from being actuated without fail. When the detection of the needle position is commenced by the NAND gate 132, a high position detecting signal is produced in response to the travel of the needle to the high position and the knife K and wiper W are actuated for a predetermined time duration by the output of the one-shot multivibrator 149 for cutting and wiping away the thread.

The cooperation of the NAND gate 133 with the one-shot multivibrator 136 energizes the electromagnetic braking unit 12, and concurrently therewith a trigger signal $Q_4$ is delivered to the reset terminal of the counter circuit 112 with the result that the output signals $S_1$ and $S_2$ are charged to the second output state. If, at this time, the pedal 5 is inadvertently reactuated and the trigger signal $Q_7$ is produced by the switch 140 of the automatic thread cutting unit 19, the signal of the second flip-flop in the second output state prevents the one-shot multivibrator 142 for actuating the picker P from being actuated.

As has been described, the control apparatus according to the invention comprises the central command means in the form of the counter to sequentially produce basic command signals so that reliability is improved and erroneous operation are reduced. In addition, it is possible to provide a different sequence mode if a signal representative of the completion of one sequence is used as a reset signal for the command circuit for sequence control. Moreover, the automatic thread cutting means is not actuated before the completion of a serial operation of continuous sewing and even when input signals in response to completions of the sewing are repeatedly applied to the automatic thread cutting means, it is enabled only by the initial input signal and disabled by the subsequent input signals, thereby preventing damage to the related devices and improving the reliability.

We Claim:

1. A control apparatus for sewing machine with automatic needle stopping means, comprising a motor for supplying a driving force to a sewing machine, a speed control device for controlling the rotational speed of said motor by controlling a driving thyristor connected to said motor, a position detector unit for detecting the position of a needle of said sewing machine, a braking unit for applying a braking force to said motor to stop said motor and said sewing machine, and a pedal manipulated by an operator for manipulating said sewing machine, said speed control device including a command unit having at least one counter means which produces central command signals to perform a predetermined sequence control, the input of said counter means being set by electrical signals generated in response to a speed detector means for detecting the speed of said motor and in response to the position of said pedal, and said counter means being reset by an output of said position detector unit.

2. A control apparatus for sewing machine with automatic needle stopping means according to claim 1, wherein an automatic thread cutting means including a picker actuated at the termination of a continuous sewing cycle of said sewing machine is prevented from operating continuously by a trigger signal in response to the actuation of said picker and an output signal of said counter means.

3. A control apparatus according to claim 1, wherein said motor is a DC motor.

4. A control apparatus according to claim 1, wherein said predetermined sequence control includes controlling the rotational speed of said motor.

5. A control apparatus according to claim 1, wherein said predetermined sequence control includes controlling the starting, rotational speed, braking and stopping of said motor.

6. A control apparatus according to claim 1, wherein said predetermined sequence control includes controlling high rotational speed and low rotational speed operation of said motor.

* * * * *